United States Patent [19]

Hagen

[11] 4,044,568

[45] Aug. 30, 1977

[54] SPACE HEATING AND COOLING SYSTEM

[75] Inventor: William F. Hagen, Argyle, Tex.

[73] Assignee: Turbo Refrigerating Company, Denton, Tex.

[21] Appl. No.: 642,906

[22] Filed: Dec. 22, 1975

[51] Int. Cl.[2] ..... F25C 5/10

[52] U.S. Cl. ..... 62/73; 62/59; 62/352

[58] Field of Search ..... 62/238, 340, 352, 73, 62/81, 277; 165/63

[56] References Cited

U.S. PATENT DOCUMENTS

| | | | |
|---|---|---|---|
| 1,180,530 | 4/1916 | Pownall | 62/352 X |
| 2,192,367 | 3/1940 | Prince | 62/238 |
| 2,892,324 | 6/1959 | Quick | 62/238 X |
| 3,045,446 | 7/1962 | Thomas | 62/352 X |
| 3,062,018 | 11/1962 | Baker | 62/81 |
| 3,181,309 | 5/1965 | Wilbushewich | 62/352 |
| 3,280,585 | 10/1966 | Lowe | 62/352 X |
| 3,913,349 | 10/1975 | Johnson | 62/352 |
| 3,926,008 | 12/1975 | Webber | 62/238 X |

*Primary Examiner*—William E. Wayner
*Assistant Examiner*—William E. Tapolcai, Jr.
*Attorney, Agent, or Firm*—McDougall, Hersh & Scott

[57] ABSTRACT

A space heating and cooling system utilizing an ice making apparatus having a refrigerant compressor and condenser and a plurality of ice making plates defining passages for the movement of refrigerant therethrough. Valves are utilized for selectively directing the refrigerant to the plates. During a given period of operation, the valves direct unexpanded refrigerant to plates having ice formed thereon whereby the heat of the unexpanded refrigerant serves to release ice from the plates. At the same time, expansion valves are utilized for directing expanded refrigerant to plates having ice forming thereon. By successively operating the valves, the plates are all used in sequence for ice forming and are all sequentially subjected to the ice releasing operation. During the period of time when heat is required, heating fluids are moved adjacent the condenser, and the heat picked up by these fluids is then employed for heating the space. During the period of time when cooling is desired, cooling fluids are obtained from an ice storage area, and these fluids are then used for cooling the space.

19 Claims, 5 Drawing Figures

FIG. 1
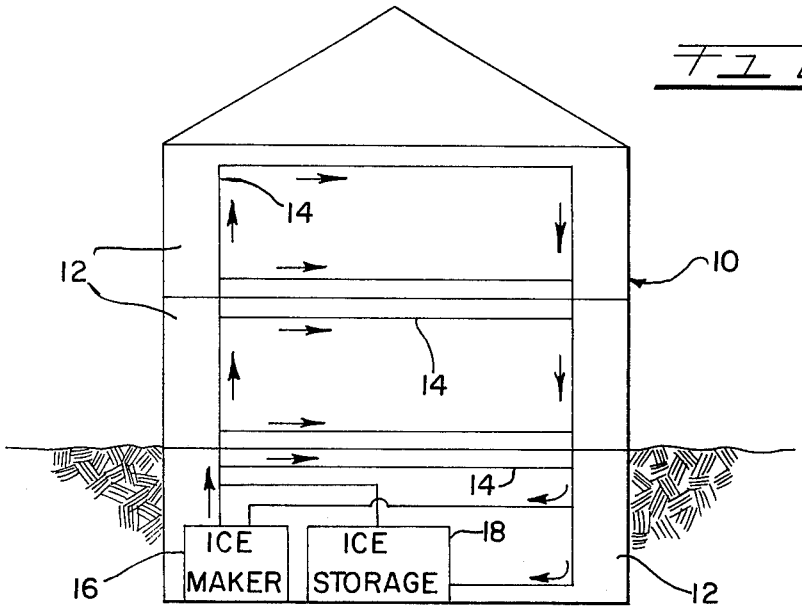
FIG. 3
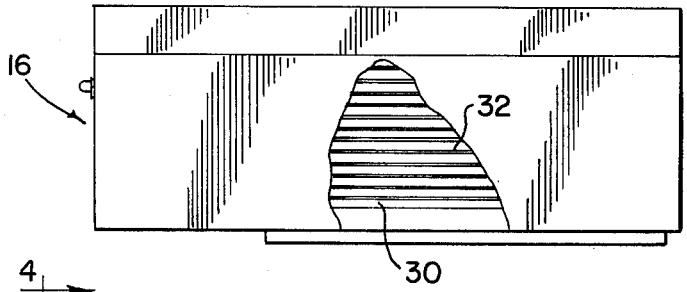
FIG. 4
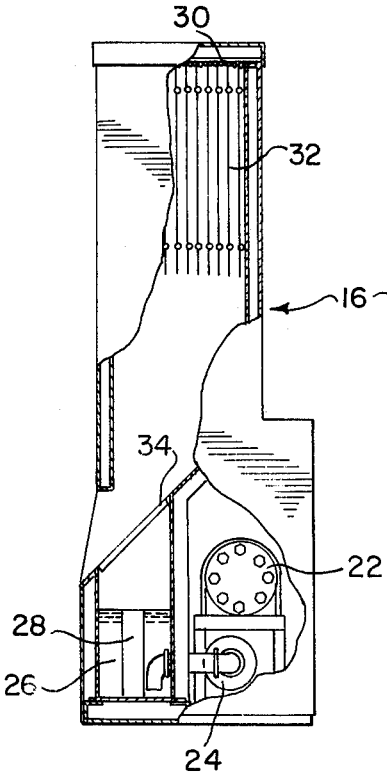
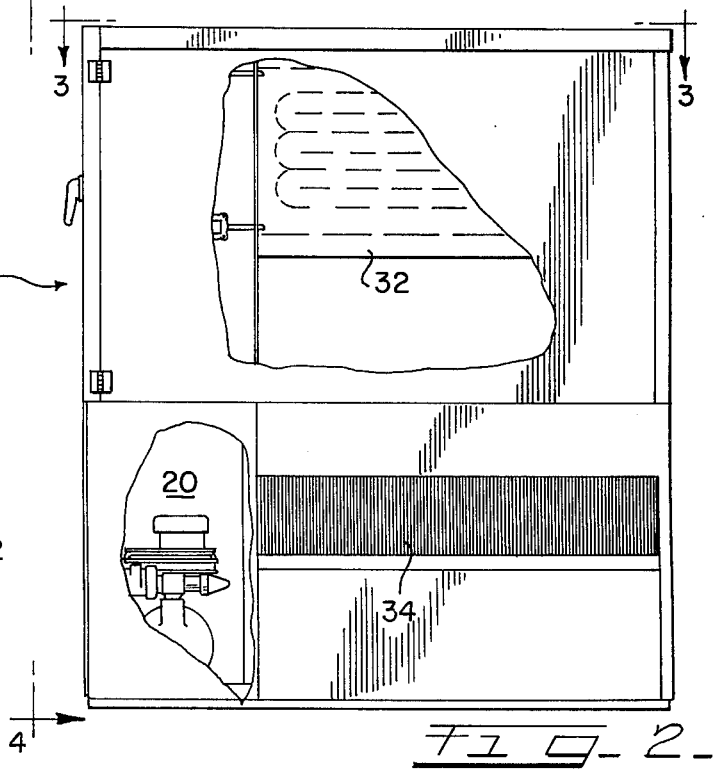
FIG. 2

SPACE HEATING AND COOLING SYSTEM

This invention relates to a system for heating and cooling a given space. For purposes of description, reference can be made to the heating and cooling of a residence. In most areas of the United States, both heating and cooling are desired on an annual basis. The system of this invention is designed to provide heating during the winter months and cooling during the summer months.

The system of the invention involves the utilization of an ice making apparatus for both heating and cooling purposes. It is, of course, well known that ice can be utilized for cooling purposes, that is, particularly by moving gas or liquids in contact with ice and then directing the cooled fluids into a cooling system for a given space. Arrangements of this type have not, however, met with acceptance since the efficiency of such arrangements has not been comparable to other available air conditioning systems.

Even if the utilization of an ice making system for air conditioning were considered feasible, such a system would still lack means for accommodating annual cycles of temperature. Thus, the mere provision of an ice making system has not been considered as providing a means for heating a space during the winter months.

It is a general object of this invention to provide an improved space heating and cooling system.

It is a more specific object of this invention to provide a space heating and cooling system which is characterized by a high degree of efficiency from the standpoint of accommodating annual cycles of temperature.

It is a still further specific object of this invention to provide an efficient system of the type described which includes an ice making operation, the operation being designed so that both heating and cooling needs can be accommodated.

These and other objects of this invention will appear hereinafter, and for purposes of illustration but not of limitation, a specific embodiment of the invention is shown in the accompanying drawings in which:

FIG. 1 is a schematic illustration of a structure having an interior space and a heating and cooling system for the space;

FIG. 2 is an elevational view of an ice making apparatus characterized by the features of the invention;

FIG. 3 is an end view of the apparatus;

FIG. 4 is a top view of the apparatus; and

Figure 5:
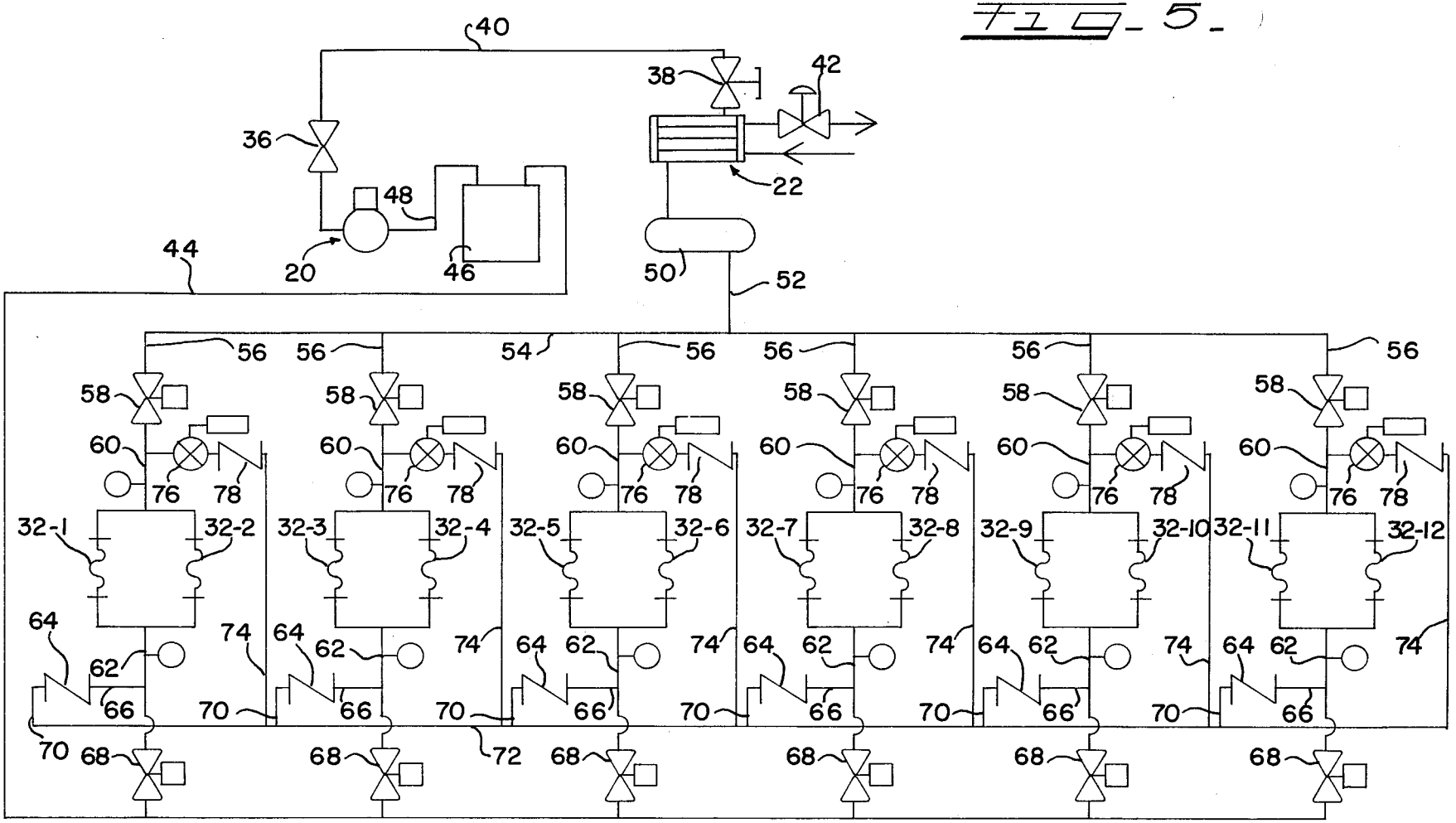
FIG. 5 is a piping schematic for the system of the invention.

The system of this invention generally comprises an apparatus and method for achieving the heating and cooling of a given space. As indicated, the invention can be described with reference to the heating and cooling of a residence located in a climate characterized by cycles of temperature whereby heating is required for a substantial period of time during the year with cooling also being required for a substantial period of time. It will also be appreciated when considering the following description that the concepts of the invention are applicable to other space heating and cooling requirements.

The system of the invention involves the utilization of an ice making apparatus. This apparatus is conventional to the extent that it utilizes a refrigerant compressor and condenser along with ice making plates defining passages for the movement of refrigerant therethrough.

In accordance with this invention, a plurality of valves are utilized for selectively controlling the movement of refrigerant. These valves include refrigerant expansion valves whereby selected ones of the plates will receive expanded refrigerant. By providing a source of water, these plates will then operate to form ice.

Additional valves are utilized for directing unexpanded refrigerant to those plates which are not being utilized for the formation of ice during a given period of the operating cycle. In these instances, the unexpanded refrigerant, being at a temperature above freezing, will heat the plate surfaces and cause the removal of ice previously formed on those surfaces. By utilizing control means for the valves, the plates can be successively subjected to ice forming and ice releasing operations whereby a continuous harvest of ice is made possible.

The ice making operation is conducted during that period of the annual cycle where heating of a space is desired. During this time, the condenser of the ice making apparatus provides a source of heat and a heating fluid such as water is moved adjacent the condenser for picking up this heat. This heating fluid is then moved through the heating system for the space involved whereby the space is heated simultaneously with the ice making operation.

The ice which is produced is stored, and a supply of ice is then available during that period of time when cooling of the space is desired. Cold water can be obtained from melted ice or a cooling fluid, such as water, may be passed in heat exchange relationship with the ice. The cold water is then circulated through a cooling system for the space involved. It will be appreciated that the operation is repeated on an annual basis. Thus, the extent of ice making can be calculated to provide a supply as long as there are cooling requirements. The supply of ice is then replenished during that part of the season requiring heating of the space involved.

In the drawings, FIG. 1 illustrates a residence 10 which includes living areas 12 requiring heating and cooling. In this illustration, heating and cooling circulating means 14 are shown for the respective areas. It will be understood that the system of this invention contemplates the use of various conventional means for heating and cooling. In particular, the circulation of hot or cold fluids in liquid or gaseous form through space heating and cooling arrangements of various types is contemplated.

In the lower space 12 of the residence, there is illustrated an ice maker 16 and an ice storage unit 18. The conduits for the heating and cooling fluids provide for circulation between the space to be heated and the ice maker or, alternatively, between the space to be heated and the ice storage unit. In a residence, this will, of course, vary with the seasons.

FIGS. 2, 3 and 4 illustrate an ice making unit 16 of a type suitable for use in the practice of the invention. This unit includes a compressor compartment 20 and an adjacent condenser 22. The condenser is water cooled, and a pump 24 is provided for delivering water to the condenser from the water reservoir 26. An overflow pipe 28 is provided for insuring a level supply of water.

Piping (not shown) is also provided for delivering water to spray tubes 30 located at the top of the unit 16. A plurality of ice making plates 32 extend downwardly from the spray tubes, and the tubes, therefore, operate to supply water to the exterior surfaces of the plates. It will be appreciated that the passage of refrigerant through the plates combined with the delivery of water to the plate surfaces will result in the formation of ice on these plates. In the arrangement illustrated, the spray tubes deliver water to both sides of the plates whereby ice is formed on both sides for maximum efficiency of operation.

As will be explained in greater detail, means are provided for periodically releasing the ice formed on the plates, and this ice then falls downwardly. The ice is directed over round slide-out bars 34 which are slightly spaced apart to permit drainage into reservoir 26. Thus, water from the spray tubes passing beyond the plates as well as any thawed ice will be separated from the ice collected from the ice maker. Any suitable means may be employed for locating the collected ice in the ice storage unit 18.

FIG. 5 comprises a piping schematic for a suitable ice making system. The schematic illustrates compressor 20 and condenser 22 with valves 36 and 38 in pipe 40 providing communication between these units. The condenser is provided with a relief valve 42 which may be set, for example, at 105° F. and 213 psig. In accordance with the usual operation of a system of the type illustrated, gaseous refrigerant is delivered through pipe 44 to accumulator 46, and is then fed from the accumulator through pipe 48 to the compressor 20. The refrigerant is liquefied in the condenser 22 and is stored in the receiver 50 for ultimate delivery through pipe 52 to the ice making plates 32.

A manifold 54 has six outlets 56, each connected to a solenoid operated valve 58. Each valve 58 is connected through a pipe 60 to a pair of plates 32. In FIG. 5, the plates 32 are designated -1 through -12 whereby six pairs of plates are identified.

An outlet pipe 62 is provided for each pair of plates, and check valves 64 communicate with pipes 62 through branch lines 66. The main lines of pipes 62 extend to solenoid operated valves 68, and each of these valves communicates with pipe 44 for delivery of refrigerant to the compressor.

Pipe sections 70 provide the outputs for check valves 64, and these pipe sections are connected to manifold 72. Pipes 74 are connected to the manifold 72, and these pipes extend to expansion valves 76 through check valves 78. The expansion valves in turn communicate with pipes 60 which lead to the respective pairs of ice making plates.

The concepts of the invention involve the sequential operation of the respective valves whereby ice making and ice harvesting operations can be simultaneously carried out. The following example is based on the assumption that the pair of plates 32-1 and 32-2 have been in an ice making state and are ready for harvesting. It is also assumed that plates 32-3 through 32-12 do not yet have sufficient ice formation for harvesting purposes.

To accomplish harvesting of plates 32-1 and 32-2, the valve 58 for these plates is opened while the valve 68 and expansion valve 76 for these plates are closed. The valves 58 for the remaining plates are closed while the valves 68 and 76 for these remaining plates are opened. Under this condition of the system, refrigerant from receiver 50 passes through the open valve 58 and through plates 32-1 and 32-2. This liquid refrigerant will typically be at a temperature of 105° F. which will, of course, melt the film of ice immediately adjacent the plate surfaces thereby resulting in release of ice from these plate surfaces. The liquid refrigerant, which is of course under high pressure, typically 213 psig, will then pass through check valve 64 to manifold 72 and then through pipes 74 to the expansion valves for each of the other pairs of plates. The refrigerant thus achieves its ice making function with respect to these other pairs of plates.

When the plates 32-1 and 32-2 have been harvested, the valve 58 for these plates will be closed, and the valves 68 and 76 opened. At the same time, the valve 58 for plates 32-3 and 32-4 will be opened, and the valves 68 and 76 for these plates will be closed. This results in the passage of the liquid refrigerant through plates 32-3 and 32-4 for harvesting ice from these plates. The refrigerant from these plates then passes through the associated check valve 64 for delivery through manifold 72 to each of the expansion valves for the other plates.

When the ice harvesting begins for plates 32-3 and 32-4, the ice making just begins for plates 32-1 and 32-2. By successively harvesting the pairs of plates, equal time for ice making will be provided. Specifically, each pair of plates will enjoy an ice making period equal to the time for harvesting ice from the five other pairs of plates. Although cycle time can vary depending on the equipment involved, a typical system would involve 2 minutes for harvest time leaving 10 minutes for ice making in a 12-minute cycle of operation. In this connection, it is preferred that relatively thin layers of ice be produced since the efficiency of the ice making decreases as the thickness of the ice on a plate increases. It is preferred that the ice thickness on a given plate vary between 3/16 to 5/16 inch.

As previously explained, the ice making operation takes place during the time that space heating is desired. The condenser 22 is of the water cooled type whereby heat generated during the condenser operation can be utilized for space heating. Typically, water at 85° F. will be introduced into the water cooling coils and will leave the coils at 95° F. When this water is circulated through the space heating system, it will give up heat in accordance with known practice. A system of the type described will provide about 165,000 BTU's per hour of heating.

The ice making operation will, of course, be "down" during the warm weather portion of an annual cycle. The ice making capabilities are preferably such that the ice harvest will be sufficient for accommodating cooling needs during this warm weather. Obviously, adjustments in the ice making and storage capabilities will be necessary depending upon the particular climate, the size of the space involved, the particular equipment available, and other factors which will be apparent to those skilled in the art.

It will be understood that various changes and modifications may be made in the system described which provide the characteristics of the invention without departing from the spirit thereof, particularly as defined in the following claims.

That which is claimed is:

1. In an ice making and harvesting system comprising a refrigerant compressor and condenser, a plurality of ice making plates defining passages for the movement of refrigerant therethrough, means for applying water to said plates for the formation of ice thereon, and a plurality of refrigerant expansion valves communicating with said plates, the improvement comprising additional valves for directing condensed refrigerant from the condenser to the plates without passing through the expansion valves, means for setting the expansion valves for selected ones of said plates for the passage of gaseous refrigerant through said selected plates, at least one of said additional valves being at the same time set for the passage of unexpanded refrigerant through plates other than said selected plates, said means for applying water applying the water only to said selected plates for the formation of ice thereon, the higher temperature of the condensed refrigerant simultaneously passing through said other plates operating to heat said other plates and to release ice formed thereon for harvesting of the ice, means for periodically operating all of said valves whereby said selected plates are successively changed whereby ice is successively formed on the plates, said other plates thereby also being successively changed whereby ice is successively harvested after formation thereof, and including means for directing the condensed refrigerant passing through said other plates to the expansion valves for said selected plates for passage of gaseous refrigerant to said selected plates.

2. A system in accordance with claim 1 wherein said plates are vertically disposed in spaced apart relationship, said refrigerant cooling both sides of each plate.

3. A system in accordance with claim 2 including water spray means interposed between each pair of plates, water from said spray means moving downwardly adjacent both surfaces of each plate.

4. A system in accordance with claim 2 including means for collecting ice positioned below said plates, said ice dropping downwardly under the influence of gravity after release of the ice from the plates.

5. A system in accordance with claim 4 including a grate structure over which said ice passes after release from said plates, water passing downwardly from said plates passing through openings in said grate structure whereby the ice is separated from the water prior to collection of the ice.

6. A system in accordance with claim 1 including a plurality of pairs of said plates, said additional valves operating to direct refrigerant from the condenser to at least one pair of plates at a time, said expansion valves being operated so that each of the other pairs of plates receives refrigerant from an expansion valve.

7. In a system for regulating the temperature of a space, the improvement comprising an ice making apparatus having a refrigerant compressor and condenser and a plurality of ice making plates defining passages for the movement of refrigerant therethrough, a plurality of refrigerant expansion valves between said plates and said condenser means, additional valves for directing refrigerant from the condenser to the plates without passing through the expansion valves, means for operating said expansion valves for the passage of refrigerant through selected ones of the plates, means for operating said additional valves for the passage of unexpanded refrigerant through the other plates, and means for applying water to said selected plates for the formation of ice thereon, the higher temperature of the unexpanded refrigerant passing through said other plates operating to heat and other plates and to release ice formed thereon for collection of the ice, and wherein said condenser comprises a water cooled condenser, and means for directing the water used for cooling the condenser adjacent said space whereby heat picked up by the water from the condenser is used for heating said space.

8. A system in accordance with claim 7 wherein said other plates are interposed between the expansion valves for said selected plates and said condenser means whereby said unexpanded refrigerant passes from said condenser means through said other plates, then to said expansion valves for said selected plates, and thus expands prior to passage through said selected plates.

9. A system in accordance with claim 7 including a plurality of pairs of said plates, said additional valves operating to direct refrigerant from the condenser to at least one pair of plates at a time, said expansion valves being operated so that each of the other pairs of plates receives refrigerant from an expansion valve.

10. In a system for regulating the temperature of a space, the improvement comprising an ice making apparatus having a refrigerant compressor and condenser and a plurality of ice making plates defining passages for the movement of refrigerant therethrough, a plurality of refrigerant expansion valves between said plates and said condenser means, additional valves for directing refrigerant from the condenser to the plates without passing through the expansion valves, means for operating said expansion valves for the passage of refrigerant through selected ones of the plates, means for operating said additional valves for the passage of unexpanded refrigerant through the other plates, and means for applying water to said selected plates for the formation of ice thereon, the higher temperature of the unexpanded refrigerant passing through said other plates operating to heat said other plates and to release ice formed thereon for collection of the ice, and including a storage area for the ice released from said ice making apparatus, and means for directing a cooling fluid from said area into proximity with said space for cooling of the space.

11. A system in accordance with claim 10 wherein said fluid comprises water formed upon melting of the ice in said storage area.

12. A system in accordance with claim 10 wherein said other plates are interposed between the expansion valves for said selected plates and said condenser means whereby said unexpanded refrigerant passes from said condenser means through said other plates, then to said expansion valves for said selected plates, and thus expands prior to passage through said selected plates.

13. A system in accordance with claim 10 including a plurality of pairs of said plates, said additional valves operating to direct refrigerant from the condenser to at least one pair of plates at a time, said expansion valves being operated so that each of the other pairs of plates receives refrigerant from an expansion valve.

14. A method for making and harvesting ice comprising the steps of providing an ice making apparatus having a refrigerant compressor and condenser and a plurality of ice making plates defining passages for the movement of refrigerant therethrough, providing expansion valves adjacent each of said plates and directing refrigerant through selected ones of said expansion valves, introducing water into contact with those plates having the passages thereof connected to said selected expansion valves for the formation of ice on those plates, providing additional valves between said condenser and said plates, connecting the passage of at least one additional valve to the plates other than those plates connected to said selected expansion valves whereby the higher temperature of the unexpanded refrigerant from the condenser will provide for the release of ice from said other plates, collecting the ice released from said other plates, successively operating said expansion and additional valves for changing their connections with said plates and for thereby forming ice on said other plates after release of ice therefrom and for releasing ice from said selected plates after formation of ice thereon, and wherein the refrigerant directed through the selected ones of said expansion valves is provided by directing the condensing refrigerant passing through said other plates to the selected ones of said expansion valves for said selected plates for passage of gaseous refrigerant to said selected plates.

15. A method in accordance with claim 14 wherein said plates extend downwardly in spaced apart relationship in said apparatus, said refrigerant cooling both sides of said plates, and including the step of spraying water onto both sides of said plates for the formation of ice.

16. A method for regulating the temperature of a space comprising the steps of providing an ice making apparatus having a refrigerant compressor and condenser and a plurality of ice making plates defining passages for the movement of refrigerant therethrough, providing expansion valves adjacent each of said plates and directing refrigerant through selected one of said expansion valves, introducing water into contact with said plates for the formation of ice on those plates having the passages thereof connected to said selected expansion valves, providing additional valves connected directly between said condenser and the other plates in said apparatus whereby the higher temperature of the unexpanded refrigerant from the condenser will provide for the release of ice from said other plates, collecting the ice released from said other plates, providing expansion valves for said other plates and additional valves for said selected plates, and successively operating said valves whereby ice is formed on said other plates after release of ice therefrom and whereby ice is released from said selected plates after formation of ice thereon, and comprising the step of moving a heating fluid adjacent said condenser whereby said fluid picks up heat from the condenser, and moving the heated fluid adjacent said space whereby the heat picked up by the fluid is used for heating said space.

17. A method in accordance with claim 16 wherein said other plates are interposed between the expansion valves for said selected plates and said condenser means whereby said unexpanded refrigerant passes from said condenser means through said other plates, then to said expansion valves for said selected plates, and thus expands prior to passage through said selected plates.

18. A method for regulating the temperature of a space comprising the steps of providing an ice making apparatus having a refrigerant compressor and condenser and a plurality of ice making plates defining passages for the movement of refrigerant therethrough, providing expansion valves adjacent each of said plates and directing refrigerant through selected ones of said expansion valves, introducing water into contact with said plates for the formation of ice on those plates having the passages thereof connected to said selected expansion valves, providing additional valves connected directly between said condenser and the other plates in said apparatus whereby the higher temperature of the unexpanded refrigerant from the condenser will provide for the release of ice from said other plates, collecting the ice released from said other plates, providing expansion valves for said other plates and additional valves for said selected plates, and successively operating said valves whereby ice is formed on said other plates after release of ice therefrom and whereby ice is released from said selected plates after formation of ice thereon, and including the steps of providing a storage area for said ice, and moving a cooling fluid from said storage area into proximity with said space for cooling said space.

19. A method in accordance with claim 18 wherein said other plates are interposed between the expansion valves for said selected plates and said condenser means whereby said unexpanded refrigerant passes from said condenser means through said other plates, then to said expansion valves for said selected plates, and thus expands prior to passage through said selected plates.

* * * * *